US008483586B2

(12) United States Patent
Kudou et al.

(10) Patent No.: US 8,483,586 B2
(45) Date of Patent: Jul. 9, 2013

(54) IMAGE FORMING APPARATUS

(75) Inventors: Kenta Kudou, Ibaraki (JP); Kenji Nozawa, Kanagawa (JP); Naoto Suzuki, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 444 days.

(21) Appl. No.: 12/779,313

(22) Filed: May 13, 2010

(65) Prior Publication Data

US 2010/0316397 A1 Dec. 16, 2010

(30) Foreign Application Priority Data

Jun. 10, 2009 (JP) ..... 2009-139378

(51) Int. Cl.
*G03G 13/05* (2006.01)
*G03G 13/22* (2006.01)

(52) U.S. Cl.
USPC ..... 399/49; 399/43; 399/71; 399/327

(58) Field of Classification Search
USPC ..... 399/43, 45, 46, 49, 51, 53, 71, 81, 399/123, 122, 320, 323, 327–330
See application file for complete search history.

(56) References Cited

U.S. PATENT DOCUMENTS

| | | | | |
|---|---|---|---|---|
| 2006/0110184 | A1* | 5/2006 | Yoshino et al. | 399/167 |
| 2007/0212086 | A1* | 9/2007 | Yagawara et al. | 399/49 |
| 2007/0280753 | A1* | 12/2007 | Tateishi et al. | 399/327 |
| 2008/0044192 | A1* | 2/2008 | Yagawara et al. | 399/49 |
| 2008/0152370 | A1* | 6/2008 | Akita | 399/49 |
| 2008/0193149 | A1* | 8/2008 | Kim | 399/15 |
| 2009/0010665 | A1* | 1/2009 | Akita | 399/51 |

FOREIGN PATENT DOCUMENTS

| | | |
|---|---|---|
| JP | 08-227218 | 9/1996 |
| JP | 3567673 | 6/2004 |
| JP | 2004-317929 | 11/2004 |
| JP | 2006-178012 | 7/2006 |
| JP | 2008-170649 | 7/2008 |
| JP | 2009-103789 | 5/2009 |

OTHER PUBLICATIONS

Office Action mailed Mar. 12, 2013, in Japanese Patent Application No. 2009-139378, filed Jun. 10, 2009, 2 pages.

* cited by examiner

*Primary Examiner* — Walter L Lindsay, Jr.
*Assistant Examiner* — Jessica L Eley
(74) *Attorney, Agent, or Firm* — Oblon, Spivak, McClelland, Maier & Neustadt, L.L.P.

(57) ABSTRACT

An image forming apparatus includes a charging unit, an image carrier, an exposing unit, a developing unit, a transfer belt on which the transfer material is placed, a fixing unit that fixes the toner image transferred onto the transfer material, a cleaning unit that cleans up toner attached to the fixing unit, and a control unit that controls printing of the image on the transfer material. The control unit causes the exposing unit to expose a latent image of a first image having an image-area ratio equal to or larger than a predetermined ratio, causes the developing unit to form a toner image of the latent image and to transfer the toner image to the transfer material, and causes the fixing unit to fix the toner image transferred by the transfer belt to the transfer material.

20 Claims, 8 Drawing Sheets

TEMPERATURE RANGE: 155°C TO 205°C
SPEED RANGE: 46.2 ppm TO 90.4 ppm

| SHEET LENGTH IN CONVEYING DIRECTION | PRINT SPEED |
|---|---|
| 182 mm [B5 LANDSCAPE] ≤ SHEET LENGTH ≤ 216 mm [LT LANDSCAPE] | 90.4 ppm |
| 216 mm [LT LANDSCAPE] < SHEET LENGTH ≤ 297 mm [A4 PORTRAIT] | 70.4 ppm |
| 297 mm [A4 PORTRAIT] < SHEET LENGTH ≤ 364 mm [B4 PORTRAIT] | 60.2 ppm |
| 364 mm [B4 PORTRAIT] < SHEET LENGTH ≤ 432 mm [LD PORTRAIT] | 51.4 ppm |
| 432 mm [LD PORTRAIT] < SHEET LENGTH ≤ 488 mm [19.2 inch] | 46.2 ppm |

FIG. 8

<CONDITION>
• USE NEW FIXING BELT

<PROCEDURE>

| PROCEDURE | SHEET | IMAGE | SIZE | 1-SIDED/ 2-SIDED | NUMBER OF PRINTED SHEETS | REMARKS |
|---|---|---|---|---|---|---|
| 1 | T6000 70W | R-COLORED ENTIRELY SOLID IMAGE | A3 | 1-SIDED | 10 | CHECK INITIAL STATE |
| 2 | T6000 70W | B-COLORED LONGITUDINAL BAND | A3 | 2-SIDED | 200 | RECORD GLOSS HISTORY |
| 3 | MONDI COLOR COPY 250 g/m$^3$ | R-COLORED ENTIRELY SOLID IMAGE | A3 | 1-SIDED | | CHECK LEVEL OF GLOSS HISTORY |

• PRINT HISTORY IMAGE ON NEW BELT AND THEN PRINT ENTIRELY SOLID IMAGE TO CHECK NUMBER OF SHEETS NECESSARY FOR IMPROVING UNEVEN GLOSS TO RANK 4

<RANKING>
• RANK UNEVEN GLOSS
RANK UNEVEN GLOSS FROM LEVEL 1 AT WHICH UNEVEN GLOSS IS CLEARLY RECOGNIZABLE TO LEVEL 5 AT WHICH UNEVEN GLOSS IS UNRECOGNIZABLE

FIG. 9

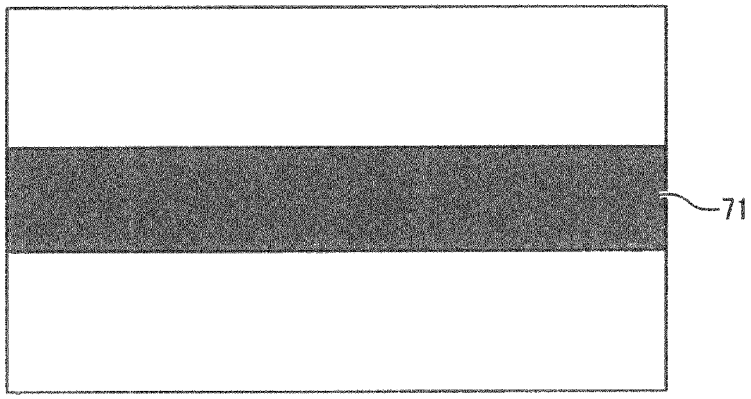

IMAGE FORMING APPARATUS

CROSS-REFERENCE TO RELATED APPLICATIONS

The present application claims priority to and incorporates by reference the entire contents of Japanese Patent Application No. 2009-139378 filed in Japan on Jun. 10, 2009.

BACKGROUND OF THE INVENTION

1. Field of the Invention

The present invention relates to an image forming apparatus.

2. Description of the Related Art

Fixing devices provided in electrophotographic image forming apparatuses are of two types: roller-type fixing devices that include upper heating rollers and lower pressing rollers (including heating rollers), and fixing-belt-type fixing devices that operate with more decreased fixing temperature and include endless fixing belts extended and rotated between a plurality of belt conveying rollers. Each type of the fixing devices fix an unfixed toner image to a transfer material such as a paper sheet by using heat and pressure while the transfer material passes through a nip formed by pressure contact between a fixing member such as a fixing roller and a pressing member such as a pressing member. Furthermore, the fixing member is provided with a cleaning device such as a take-up cleaner web to clean up residual toner and the like attached to the fixing member.

As described above, the toner image is fused and fixed onto a recording material at the nip portion. However, unfixed toner remains attached to the fixing member, and in some cases, some residual toner is not cleaned up by the above-mentioned cleaning device and remains attached as an image history, or a residual image that is not wiped out, on the fixing member. Conventionally, the fixing member is provided with a release-agent supply device that supplies release agents to reduce the residual toner attached to the fixing member.

To solve the above problems, Japanese Patent Application Laid-open No. H10-301431 for example discloses a technology in which a fixing device including a fixing member, formed of a heating member and a pressing member is provided with a release-agent supply device that can uniformly and stably supply release agents onto a surface of at least one of the heating member and the pressing member of the fixing device. Furthermore, a technology for cleaning a surface of the fixing member by using a solid-black toner image, i.e., a cleaning sheet, is disclosed in, for example, Japanese Patent Application Laid-open No. 2004-317929. More specifically, the cleaning sheet is inserted into a nip portion so as to be in contact with the surface of the fixing member and to be heated. Accordingly, an adhesive property of a cleaning layer is increased, thereby allowing paper dust, toner, and the like attached to the fixing member to adhere to the cleaning layer. As a result, the surface of a fixing roller is cleaned.

However, in the technology disclosed in Japanese Patent Application Laid-open No. H10-301431, residual toner that has not been cleaned up may be attached to the fixing member at any portions of an outlet of the nip portion, leading to fine irregularities on the fixing member. Furthermore, in the technology disclosed in Japanese Patent Application Laid-open No. 2004-317929, while the residual toner is removed from the fixing member by utilizing the adhesive property of the cleaning layer, some residual toner may not be removed by the cleaning sheet and may be attached to the fixing member, leading to fine irregularities on the fixing member. Such fine irregularities on the fixing member make it difficult to eliminate and reduce uneven gloss that may occur when a toner image is fixed to a next transfer material as a next printing object.

SUMMARY OF THE INVENTION

It is an object of the present invention to at least partially solve the problems in the conventional technology.

According to an aspect of the present invention, there is provided an image forming apparatus including: a charging unit; an image carrier charged by the charging unit; an exposing unit that projects light corresponding to an image to be printed to the image carrier to form a latent image; a developing unit that forms a toner image of the latent image formed by the exposing unit and transfers the toner image to a transfer material fed from a feed tray; a transfer belt on which the transfer material is placed, and that feeds the transfer material to the developing unit to transfer the toner image; a fixing unit that fixes the toner image transferred onto the transfer material; a cleaning unit that cleans up toner attached to the fixing unit; and a control unit that controls printing of the image on the transfer material, wherein the control unit causes the exposing unit to expose a latent image of a first image having an image-area ratio equal to or larger than a predetermined ratio, causes the developing unit to form a toner image of the latent image and to transfer the toner image to the transfer material, and causes the fixing unit to fix the toner image transferred by the transfer belt to the transfer material.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 8 is a diagram illustrating the number of transfer materials used for leaving an image history on the fixing belt, a condition for testing levels of uneven gloss, and a procedure of the test;

FIG. 9 is a diagram representing an example of an image used for leaving the image history on the fixing belt;

DETAILED DESCRIPTION OF THE PREFERRED EMBODIMENTS

Exemplary embodiments of an image forming apparatus according to the present invention are explained in detail below with reference to the accompanying drawings.

Figure 1:
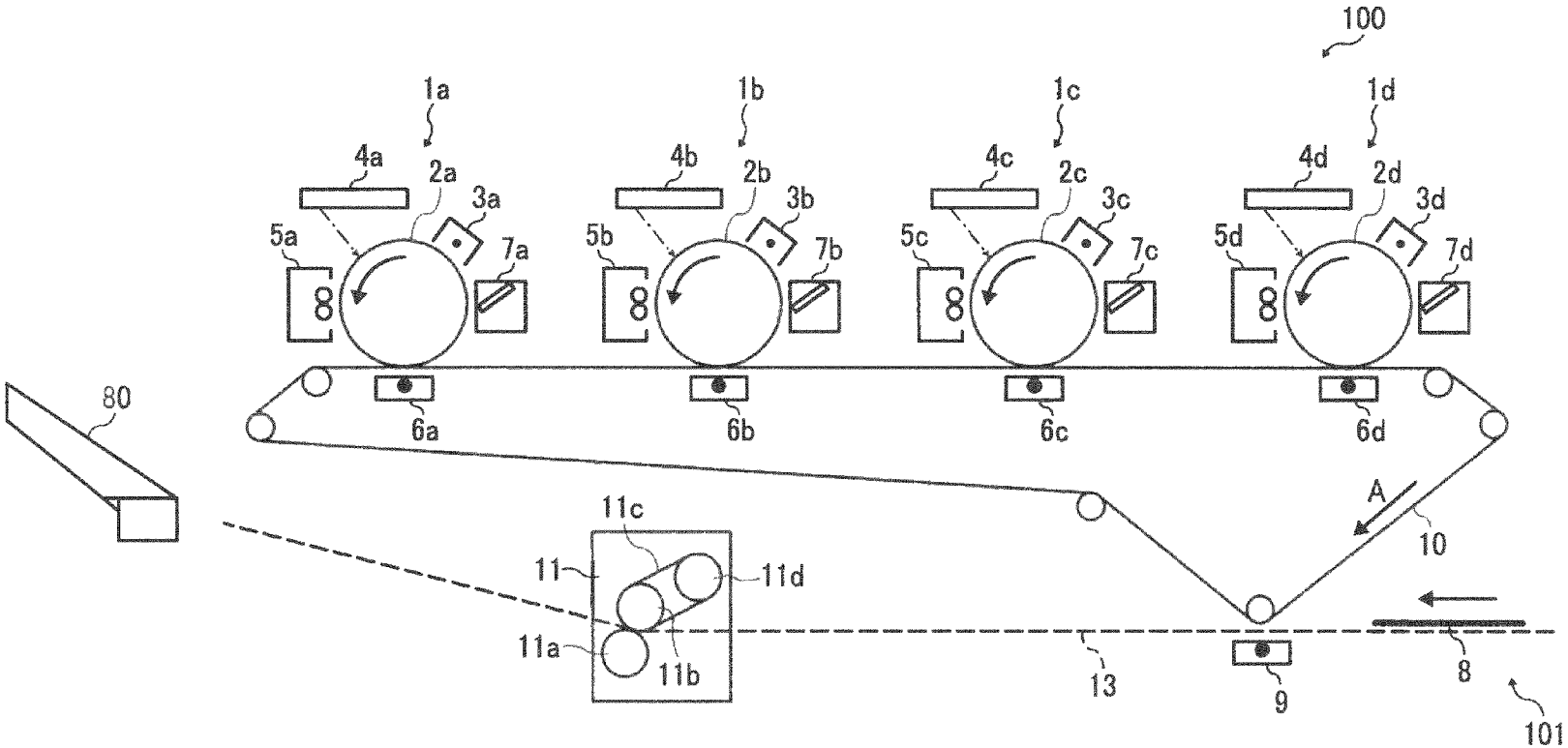
FIG. 1 is a diagram schematically illustrating an internal configuration of an image forming apparatus.

A configuration of an image forming apparatus according to a present embodiment is described below. In the explanation of the present embodiment, a tandem-type color multi-function peripheral that includes photosensitive elements for colors of yellow (Y), magenta (M), cyan (C), and black (K) and that can perform full-color printing is used as an example of the image forming apparatus. FIG. 1 is a diagram schematically illustrating an internal configuration of the image forming apparatus. The image forming apparatus includes an image forming section 100 located in the center of a body of the image forming apparatus, a sheet feeding unit 101 located below the image forming section 100, an image reading unit (not shown) located above the image forming section 100, a control unit (not shown) that controls the whole image forming apparatus, and an operation panel (not shown) that allows users to perform operation input and that displays information. A transfer material 8 is fed into the sheet feeding unit 101 from a sheet feed tray (not shown) in which transfer materials such as paper sheets are stacked. The control unit includes a CPU (central processing unit), a main storage unit such as a ROM (read only memory) and a RAM (random access memory) for storing various types of data and various types of computer programs, and an auxiliary storage unit such as an HDD (hard disk drive) and a CD (compact disk) drive for storing various types of data and various types of computer programs. The control unit controls the whole image forming apparatus by executing the various types of computer programs stored in the main storage unit and in the auxiliary storage unit.

The image forming section 100 includes image forming units 1*a*, 1*b*, 1*c*, and 1*d* for respective colors of Y (yellow), M (magenta), C (cyan), and K (black), a sheet transfer unit 9, a transfer belt 10, a fixing device 11, a secondary transfer belt 13, and a discharge tray 80. The image forming units 1*a*, 1*b*, 1*c*, and 1*d* are arranged along a moving direction of the transfer belt 10. The image forming units 1*a*, 1*b*, 1*c*, and 1*d* include photosensitive elements 2*a* to 2*d* as image carriers, drum charging units 3*a* to 3*d*, exposing devices 4*a* to 4*d*, developing units 5*a* to 5*d*, transfer units 6*a* to 6*d*, and cleaning devices 7*a* to 7*d*, respectively, and form toner images of respective colors of Y, M, C, and K in this order. Data of an image to be printed is converted into image data for each of K (black), Y (yellow), C (cyan), and M (magenta), and then each sent to the exposing devices 4*a* to 4*d* for the respective colors. The exposing devices 4*a* to 4*d* apply light to expose the photosensitive elements 2*a* to 2*d* to thereby form electrostatic latent images, respectively. The drum charging units 3*a* to 3*d* charge the photosensitive elements 2*a* to 2*d*, respectively. The developing units 5*a* to 5*d* develop the electrostatic latent images formed on the photosensitive elements 2*a* to 2*d* to thereby form toner images, respectively. The transfer units 6*a* to 6*d* transfer the toner images, formed on the photosensitive elements 2*a* to 2*d*, onto the transfer belt 10, respectively. The cleaning devices 7*a* to 7*d* clean the photosensitive elements 2*a* to 2*d*, respectively. The transfer belt 10 is in the form of an endless belt and is rotated in a direction A shown in the figure. The sheet transfer unit 9 is applied with a high voltage to thereby transfer the toner image formed on the transfer belt 10 onto the transfer material 8. The secondary transfer belt 13 conveys the transfer material 8 to the discharge tray 80 via the sheet transfer unit 9 and the fixing device 11. The toner images formed by the image forming units 1*a*, 1*b*, 1*c*, and 1*d* are superimposed one on top of the other onto the transfer belt 10, so that a four-color toner image is formed on the transfer belt 10. When the toner image formed on the transfer belt 10 arrives at the sheet transfer unit 9, the toner image is transferred onto the transfer material 8, which is conveyed to a position facing the secondary transfer belt 13, due to an action of a high voltage applied to the sheet transfer unit 9. The latent image transferred onto the transfer material 8 is fused and pressed to be fixed while being passed through the fixing device 11.

Figure 2:
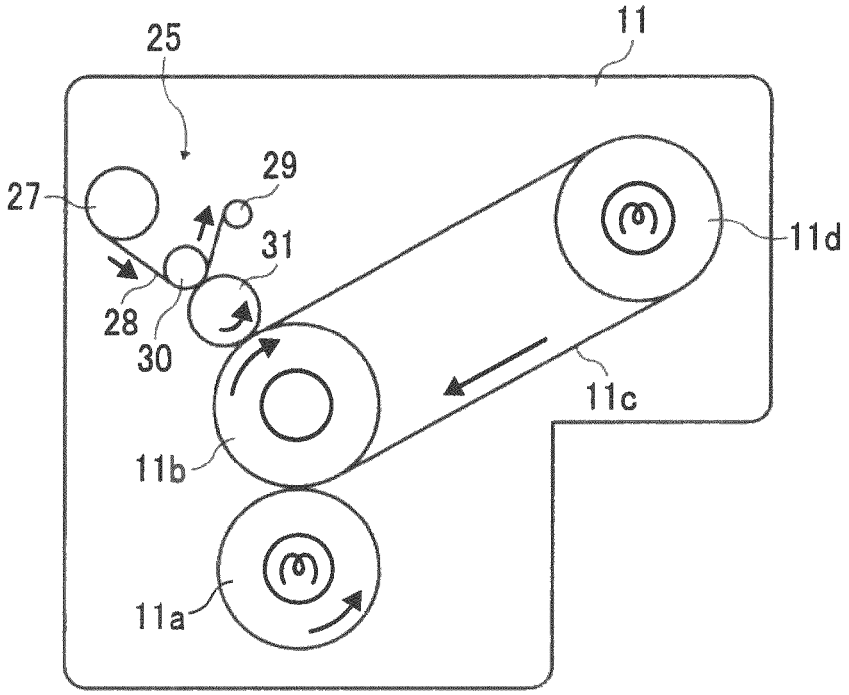
FIG. 2 is a diagram representing an example of an internal configuration of a fixing device.

The fixing device 11 includes a pressing roller 11*a* having a heat source provided therein with such as a halogen lamp, a fixing roller 11*b*, a fixing belt 11*c* in the form of an endless belt, and a heating roller 11*d* having a heat source such as a halogen lamp. FIG. 2 is a diagram representing an example of an internal configuration of the fixing device 11. The fixing device 11 further includes a toner cleaning unit 25 in addition to the pressing roller 11*a*, the fixing roller 11*b*, the fixing belt 11*c*, and the heating roller 11*d*. The toner cleaning unit 25 includes a winding roll 27, a cleaner web 28, and a take-up roll 29.

The fixing belt 11*c* is extended between the fixing roller 11*b* and the heating roller 11*d*, and endlessly moves along with rotation of the heating roller 11*d*. The extended fixing belt 11*c* is heated by the heating roller 11*d*. The control unit controls ON/OFF of power supply to the heat source of the heating roller 11*d*. The pressing roller 11*a* is brought into contact with the fixing belt 11*c* at a position where the fixing belt 11*c*, which is endlessly moving, is wound around the fixing roller 11*b*, so that a fixing nip is formed. The above-mentioned transfer material 8 is nipped at the fixing nip portion, so that the toner image is fixed to the transfer material 8 due to heat and pressure. At this time, toner is melted at the fixing nip portion and residual toner that has not been fixed to the transfer material 8 adheres to the fixing belt 11*c* at an outlet of the nip portion.

The toner cleaning unit 25 cleans up the residual toner attached to the fixing belt 11*c*. A fixing cleaning roller 31, which is made of material with less release property than the fixing belt 11*c*, is brought into contact with the fixing belt 11*c* at a position downstream of the fixing nip portion, so that the residual toner attached to the fixing belt 11*c* adheres to the fixing cleaning roller 31. The take-up cleaner web 28 of the toner cleaning unit 25 is brought into contact with the fixing cleaning roller 31, and the cleaner web 28 wipes off the residual toner attached to the fixing cleaning roller 31. The cleaner web 28 has a belt-like shape and is wound around the winding roll 27. The cleaner web 28 extended from the winding roll 27 can be rewound by rotation of the take-up roll 29. The cleaner web 28 at a position between the winding roll 27 and the take-up roll 29 is brought into contact with the fixing belt 11*c* by a cleaner-web pressing roller 30. At this state, the take-up roll 29 is appropriately rolled up according to an amount of dirt on the fixing belt 11*c* so that a clean portion of the cleaner web 28 is brought into contact with the fixing cleaning roller 31. Consequently, the dirt on the fixing cleaning roller 31 is removed, and therefore, the fixing belt 11*c* being in contact with the fixing cleaning roller 31 is cleaned.

Figure 3:
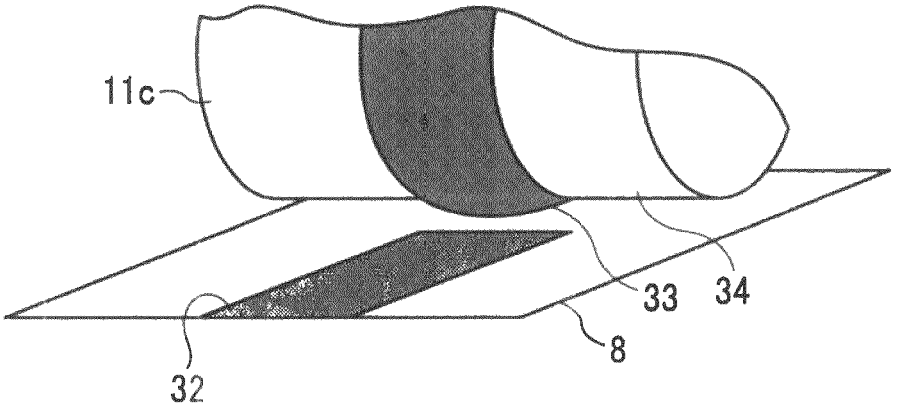
FIG. 3 is a diagram for explaining how to fix a toner image at a fixing nip portion.

Next, how to fix the toner image at the fixing nip portion is described below with reference to FIG. 3. The transfer material 8 with a toner image 32 is heated by the pressing roller 11*a* and pressed by the fixing belt 11*c* and the fixing roller 11*b* (see FIG. 2), so that the toner image 32 is fixed to the transfer material 8. At this time, an unfixed toner image remains attached to the fixing belt 11*c*. Almost all attached substances are removed by the toner cleaning unit 25 shown in FIG. 2. However, some attached substances remain attached and form an image history 33, or a residual image.

Generally, when printing is performed, an identical image is often used to be printed in large numbers, and the above-mentioned image history 33 is continuously attached to an identical portion. Accordingly, irregularities occur because of a portion where the image history 33 is left on the fixing belt 11*c*, i.e., a projecting portion (convex portion) 33, and a portion where the image history 33 is not left, i.e., a recessed portion (concave portion) 34 having low toner density. The irregularities cause uneven gloss at next fixation of a toner image, i.e., at next printing.

Figures 4, 5:
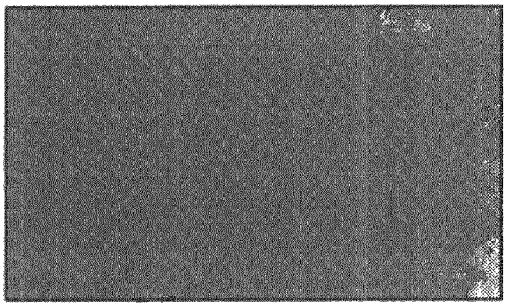
FIG. 4 is a diagram representing an example of an entirely solid image.
FIG. 5 is a diagram representing an example of a range of a fixing temperature and print speed depending on a size of a transfer material.

In the present embodiment, the irregularities that occur on the fixing belt 11*c* as described above are smoothed out to eliminate or reduce occurrence of the uneven gloss at next fixation of a toner image. More specifically, the control unit receives operation input for printing an entirely solid image via the operation panel, and causes at least one of the image forming units 1*a* to 1*d* to form the entirely solid image. The entirely solid image is an image having an image-area ratio equal to or larger than a predetermined ratio (e.g., 90%). FIG. 4 is a diagram representing an example of the entirely solid image. The entirely solid image shown in the figure has the image-area ratio of 100%. In this example, it is assumed that K-color toner is used for forming the entirely solid image. However, Y-, M-, and C-color toners can also be used. The control unit causes at least one of the image forming units 1*a* to 1*d* to form the image according to the toner to be used. Then, the control unit performs control to form a toner image, which is obtained by the above formation of the image, on the transfer belt 10 shown in FIG. 1, and then causes the fixing device 11 to fix the toner image to the transfer material 8. In this case, the control unit controls a fixing temperature and print speed at the fixing device 11 in the same manner as at normal printing. FIG. 5 is a diagram representing an example of a range of the fixing temperature and the print speed depending on a size of the transfer material 8. With the control as described above, the entirely solid image is printed on the transfer material 8. Then, the control unit performs control to discharge the printed transfer material 8 to the discharge tray 80. At the normal printing, when a user performs, via the operation panel, operation input for instructing printing of a specified image and selecting a size and a type of a sheet to be printed, the control unit controls the image forming units 1*a* to 1*d* to form toner images for respective colors according to the specified image in response to the operation input.

Figure 6:
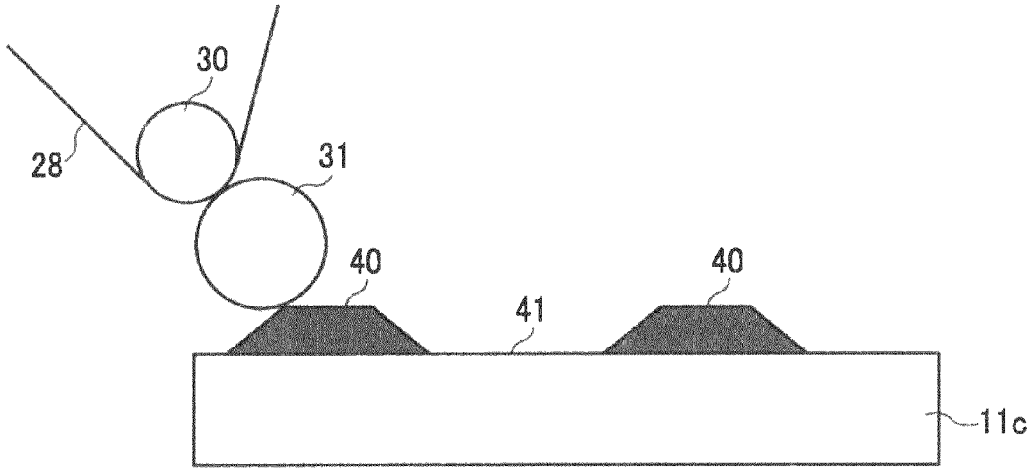
FIG. 6 is a diagram for explaining how to smooth out irregularities on a fixing belt.
Figure 7:
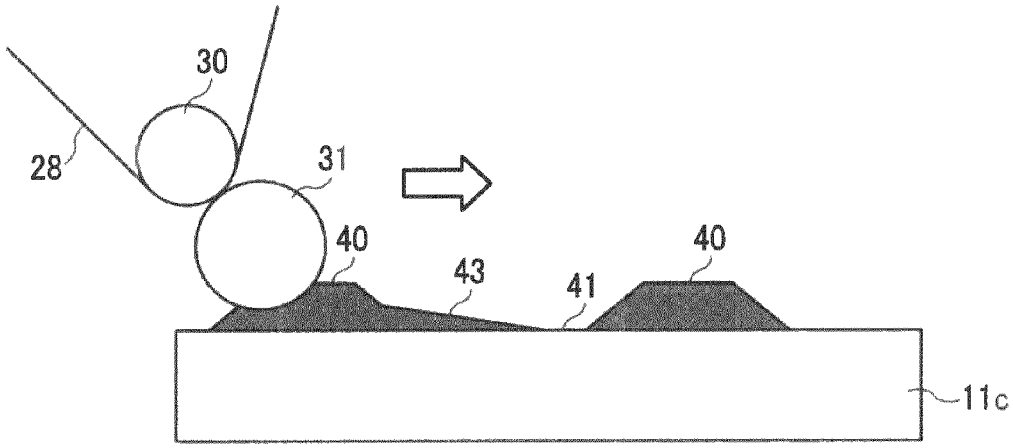
FIG. 7 is a diagram for explaining how to smooth out irregularities on the fixing belt.

FIGS. 6 and 7 are diagrams for explaining how to smooth out irregularities on the fixing belt 11*c*. As described with reference to FIG. 3, the image history is left on the fixing belt 11*c* because of continuous printing of an identical image. In other words, as shown in FIG. 6, a convex portion 40 and a concave portion 41 formed by the residual toner are generated on the fixing belt 11*c*. Therefore, by printing the entirely solid image shown in FIG. 4 to leave an image history on the whole fixing belt 11*c*, the residual toner is evenly attached to the fixing belt 11*c*, so that the concave portion 41 is filled with the residual toner. Furthermore, because the toner cleaning unit 25 cleans the surface of the fixing belt 11*c* via the fixing cleaning roller 31 being in contact with the fixing belt 11*c*, the convex portion 40 can be trimmed. As a result, the irregularities on the fixing belt 11*c* tend to be smoothed out.

The reason why the uneven gloss is less likely to occur when a large number of the transfer materials 8 are printed is as follows. That is, when the cleaner web 28 cleans the fixing belt 11*c*, shavings 43 from the convex portion 40 adhere to the concave portion 41 so as to help to smooth out the irregularities, and therefore, a difference between the concave and convex is decreased.

Next, a test for investigating a relationship between the number of the transfer materials to be printed and levels of the uneven gloss is described below. FIG. 8 is a diagram illustrating the number of the transfer materials 8 used for leaving an image history on the fixing belt 11*c*, a condition for testing the levels of the uneven gloss, and a procedure of the test. FIG. 9 is a diagram representing an example of an image used for leaving the image history on the fixing belt 11*c*. As shown in the figure, a toner image 71 having a belt-like shape appears in the center. In this example, the uneven gloss is ranked from level 1 to level 5. The level 5 is a level at which the uneven gloss is unrecognizable, the level 4 is a level at which the uneven gloss is almost unrecognizable, the level 2 is a level at which the uneven gloss is almost recognizable, and the level 1 is a level at which the uneven gloss is clearly recognizable. The levels of the uneven gloss are confirmed by viewing the result of a printed image. In the test procedure shown in FIG. 8, whether the uneven gloss caused by any image histories has occurred or not is checked at the first procedure. Then, at the second procedure, printing is performed to fix the toner image, shown in FIG. 9, to 200 (two hundred) transfer members for leaving the image history on the fixing belt 11*c*. Subsequently, at the third procedure, printing is performed to fix the entirely solid image shown in FIG. 4 to transfer materials to investigate the number of transfer materials needed to be printed to improve the uneven gloss to the level 4.

Figure 10:
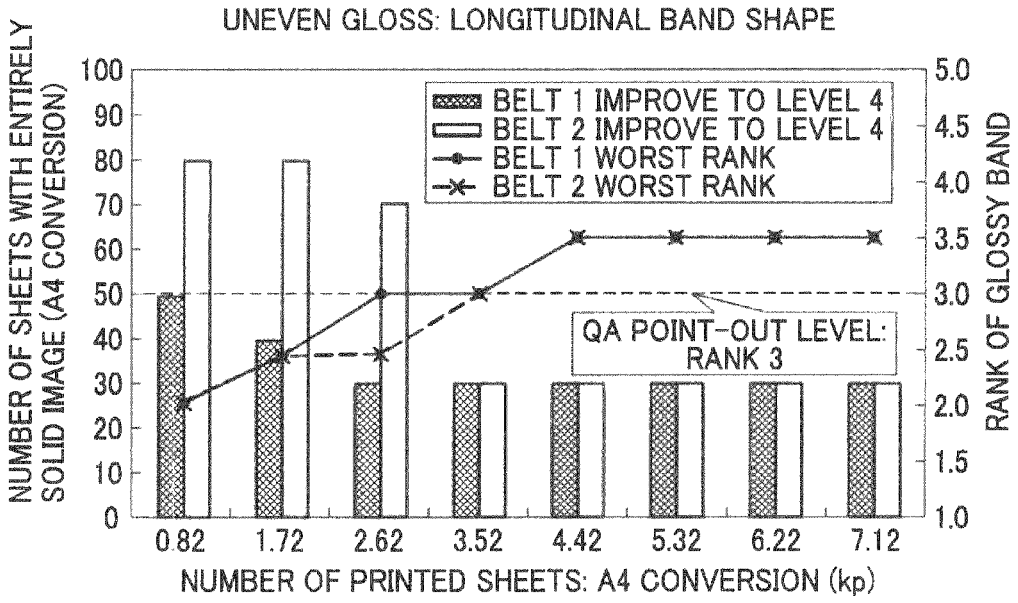
FIG. 10 is a graph illustrating the number of entirely solid images needed to be printed to improve the uneven gloss to level 4.

FIG. 10 is a diagram illustrating a graph illustrating the number of the entirely solid images needed to be printed to improve the uneven gloss to the level 4. When the fixing belt 11*c* is relatively new, i.e., when the total number of printed transfer materials is relatively small, the image history is likely to be left, so that a relatively large number (about 80 (eighty)) of the entirely solid images need to be printed to improve the level of the uneven gloss to the level 4. In this case, the worst value of the level of the uneven gloss remains at the level 2. In contrast, when the total number of printed transfer materials reaches about 4400 (four thousand four hundred), an image history is less likely to be left even when an image whose image history tends to be left is printed, so that the level of the uneven gloss of the first entirely solid image remains at about 3.5, and the level of the uneven gloss is improved to the level 4 after about 15 transfer materials are printed. Furthermore, the worst value of the level of the uneven gloss in this case remains at the level 3.5.

According to the result of the above test, it is found that, when the number of printed transfer materials is small, irregularities are likely to occur by the residual toner, i.e., the image history is likely to be left on the fixing belt 11*c*, and, when the number of printed transfer materials reaches about 4400, even when an image whose image history tends to be left is printed, the uneven gloss at next printing can be eliminated or reduced by printing only a relatively small number (about 15 (fifteen)) of the entirely solid images.

(Operations)

Figure 11:
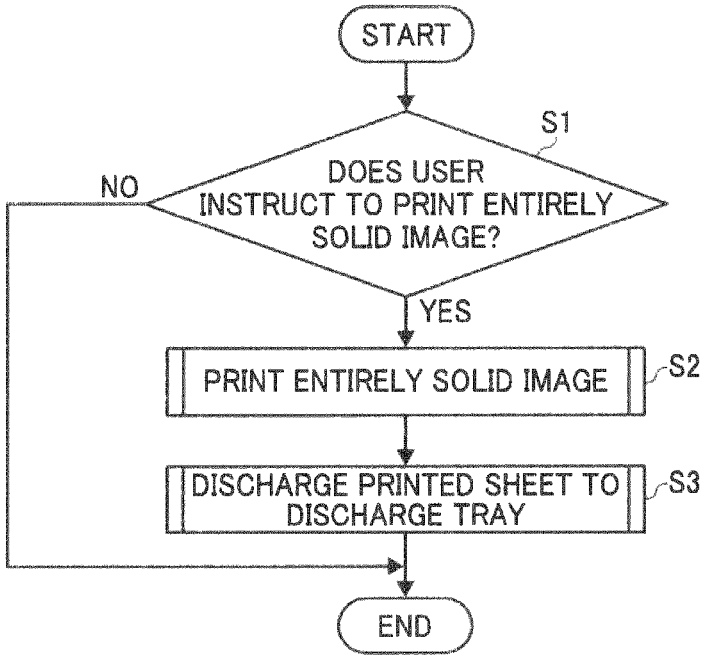
FIG. 11 is a flowchart of a procedure of an entirely-solid-image printing process performed by the image forming apparatus.

Next, a procedure of an entirely-solid-image printing process performed by the image forming apparatus according to the present embodiment is described below with reference to FIG. 11. When a user performs operation input for instructing printing of an entirely solid image via the operation panel of the image forming apparatus, the control unit receives the operation input (YES at Step S1), and performs printing of the entirely solid image as shown in FIG. 4 according to the operation input (Step S2). More specifically, the control unit causes at least one of the image forming units 1*a* to 1*d* to form the entirely solid image, performs control to form the formed toner image on the transfer belt 10 shown in FIG. 1, and causes the fixing device 11 to fix the toner image to a transfer material such as a paper sheet. The control unit then performs control to discharge the printed paper sheet to the discharge tray 80 (Step S3). When the determination at Step S1 is negative, the control unit does not perform printing of the entirely solid image and ends the process.

As described above, by printing the entirely solid image, residual toner is evenly attached to both a portion (convex portion) to which residual toner has been attached on the fixing belt 11*c* and a portion (concave portion) to which residual toner has not been attached. Therefore, when the toner cleaning unit 25 cleans the residual toner being attached, the residual toner on the fixing belt 11*c* can be leveled out. As a result, it is possible to eliminate or reduce the uneven gloss at next printing.

In the technology disclosed in Japanese Patent Application Laid-open No. 2004-317929 described in the Description of the Related Art section, residual toner on a fixing belt is removed by utilizing the adhesive property of the cleaning sheet. In contrast, in the present embodiment, an image history is maintained on the fixing belt 11*c* and residual toner is intentionally attached to the fixing belt 11*c* by printing the entirely solid image. With this configuration, irregularities caused by the residual toner on the fixing belt 11*c* can be smoothed out regardless of residual toner remained unremoved.

Modified Example

The present invention is not limited to the embodiments described above. The present invention may be implemented by modifying the constituent elements within the scope of the present invention. Furthermore, various inventions may be made by appropriately combining a plurality of the constituent elements disclosed in the embodiments described above. For example, it is possible to omit some of the constituent elements among all the constituent elements described in the embodiments. Moreover, it is possible to combine, as necessary, the constituent elements from mutually different ones of the embodiments. Furthermore, it is acceptable to apply various types of modifications as described below.

Modified Example 1

In the embodiments described above, various types of computer programs to be executed by the image forming apparatus may be stored in a computer connected via a network such as the Internet so that they can be downloaded for distribution via the network. Furthermore, the various types of computer programs may be recorded on a computer-readable recording medium, such as a CD-ROM, a flexible disk (FD), a CD-R, and a DVD (Digital Versatile Disk), in an installable format or an executable format for distribution as a computer program product.

Modified Example 2

Figure 12:
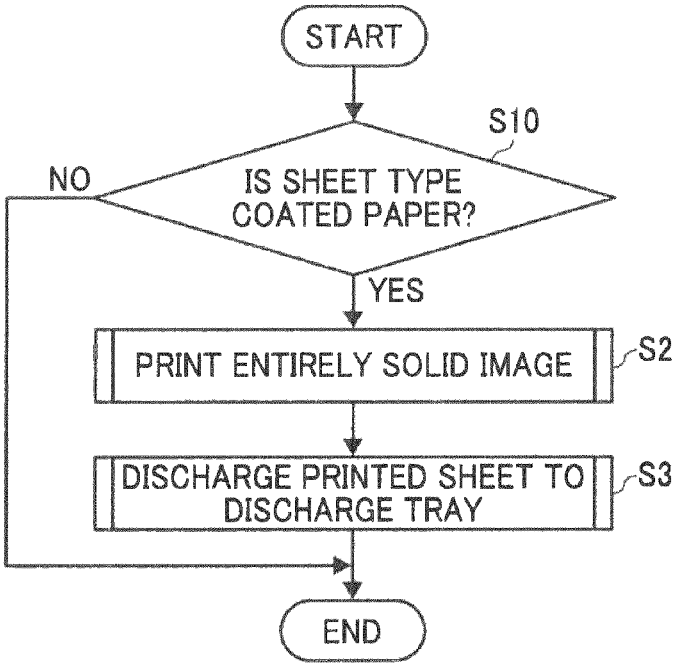
FIG. 12 is a flowchart of a procedure of an entirely-solid-image printing process according to a modified example.

In the embodiments described above, the entirely-solid-image printing process is performed according to the operation input performed by a user for instructing printing of the entirely solid image; however, it may be performed according to a type of a sheet being a transfer material to be printed. The uneven gloss caused by the image history left on the fixing belt 11*c* more clearly appears on coated papers. Therefore, it is possible to perform the entirely-solid-image printing process when the type of a sheet corresponds to a coated paper. FIG. 12 is a flowchart of a procedure of an entirely-solid-image printing process according to the present modified example. In this example, it is assumed that a user performs operation input for printing a specified image and selecting a type of a sheet to be printed, via the operation panel of the image forming apparatus. At Step S10, the control unit of the image forming apparatus determines whether the type of the sheet to be printed is a coated paper or not when performing printing according to the operation input. When the determination at Step S10 is positive, the control unit performs subsequent processes from Step S2 in the same manner as the first embodiment described above. When the determination at Step S10 is negative, the control unit does not perform printing of the entirely solid image and ends the process. Subsequently, the image forming apparatus performs normal printing to print an image specified by the user on a sheet of the type selected by the user, according to the operation input performed by the user.

With the configuration described above, it is possible to level out the residual toner on the fixing belt 11*c*, and in particular, it is possible to eliminate or reduce the uneven gloss at printing on coated papers. Furthermore, because the entirely-solid-image printing process is not performed when the type of a sheet to be printed is not a coated paper, it is possible to reduce unnecessary printing of the entirely solid image.

Modified Example 3

Figure 13:
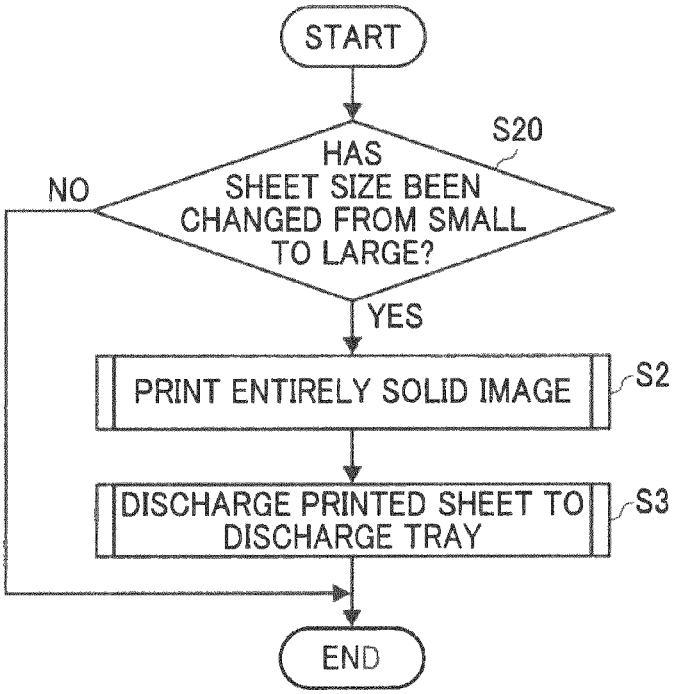
FIG. 13 is a flowchart of a procedure of an entirely-solid-image printing process according to another modified example.

The entirely-solid-image printing process may be performed according to the size of a sheet being a transfer material to be printed. When the size of the sheet is changed from small to large, a difference at least in toner density occurs at a portion corresponding to a difference between the sizes. Therefore, it is preferable to perform the entirely-solid-image printing process when the size of the sheet is changed from small to large. FIG. 13 is a flowchart of a procedure of an entirely-solid-image printing process according to the present modified example. In this example, it is assumed that a user performs operation input for instructing printing of a specified image and selecting a size of a sheet to be printed, via the operation panel of the image forming apparatus. At Step S20, the control unit of the image forming apparatus determines whether the size of the sheet to be printed has been changed from small to large when performing printing according to the operation input. This is implemented by, for example, causing the control unit to store a size of a previously-printed sheet and to compare the size of a sheet selected by the current operation input with the stored size. When the determination at Step S20 is positive, the control unit performs subsequent processes from Step S2 in the same manner as the first embodiment described above. When the determination at Step S20 is negative, the control unit does not perform the entirely-solid-image printing process and ends the process. Subsequently, the image forming apparatus performs normal printing to print an image specified by the user on a sheet of the size selected by the user, according to the operation input performed by the user.

With the configuration described above, it is possible to level out the residual toner on the fixing belt 11*c*, and in particular, it is possible to eliminate or reduce the uneven gloss when the size of the sheet to be printed is changed from small to large. Furthermore, because the entirely-solid-image printing process is not performed when the size of the sheet to be printed is not changed from small to large, it is possible to reduce unnecessary printing of the entirely solid image.

Modified Example 4

Figure 14:
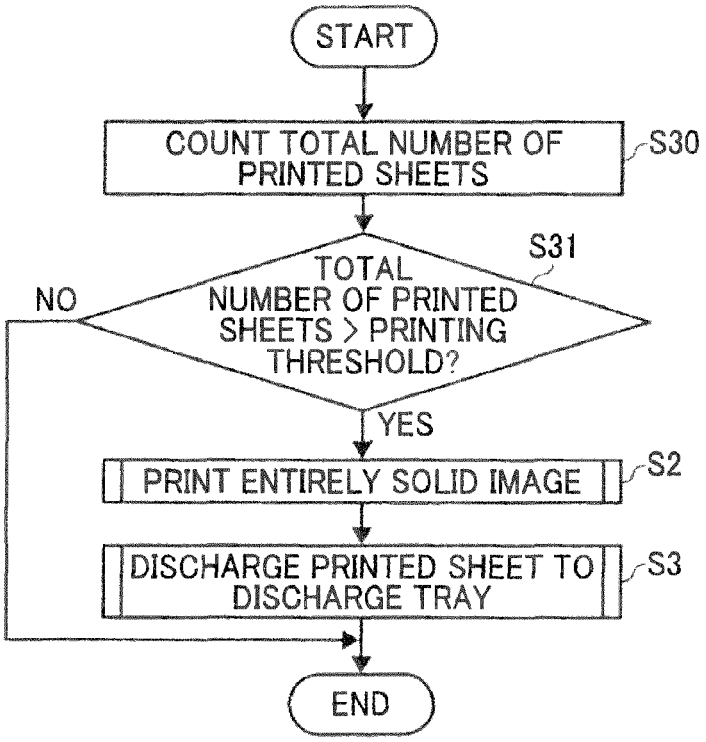
FIG. 14 is a flowchart of a procedure of an entirely-solid-image printing process according to still another modified example.

The entirely-solid-image printing process may be performed according to the total number of sheets of printed transfer materials (the number of printed sheets). FIG. 14 is a flowchart of a procedure of an entirely-solid-image printing process according to the present modified example. When a user performs operation input for instructing printing of a specified image via the operation panel of the image forming apparatus, and upon receiving the operation input, the control unit counts the total number of printed sheets (Step S30), and determines whether the total number of printed sheets exceeds a predetermined number set in advance (e.g., 4400 according to the test result exemplary shown in FIG. 10) or not (Step S31). When the determination at Step S31 is positive, the control unit performs subsequent processes from Step S2 in the same manner as the first embodiment described above. At this time, the control unit may reset the number of printed sheets. When the determination at Step S31 is negative, the control unit does not perform the entirely-solid-image printing process and ends the process. Subsequently, the image forming apparatus performs normal printing to print an image specified by the user on a sheet according to the operation input performed by the user.

With the configuration described above, it is possible to level out the residual toner on the fixing belt 11*c* every time the total number of printed sheets reaches a predetermined number, and it is possible to eliminate or reduce the uneven gloss at printing. Furthermore, because the entirely-solid-image printing process is not performed when the total number of printed sheets does not reach the predetermined number, it is possible to reduce unnecessary printing of the entirely solid image.

Moreover, the number of sheets for printing the entirely solid image may be changed depending on the amount of use of the fixing belt 11*c*. The amount of use of the fixing belt 11*c* corresponds to, for example, the total number of printed sheets described above. In this case, the control unit of the image forming apparatus may count the total number of printed sheets and perform printing in the following manner. That is, when the total number of printed sheets exceeds a first predetermined number set in advance, the control unit prints the first predetermined number of the entirely solid images at Step S2; when the total number of printed sheets is equal to or smaller than the first predetermined number set in advance and equal to or larger than a second predetermined number set in advance, the control unit prints the second predetermined number of the entirely solid images at Step S2; and when the total number of printed sheets is smaller than the second predetermined number set in advance, the control unit does not print the entirely solid image and ends the process.

Modified Example 5

The entirely-solid-image printing process may be performed according to a thickness of a sheet being a printed transfer material. It is assumed here that a user performs operation input for instructing printing of a specified image and selecting a thickness of a sheet to be printed, via the operation panel of the image forming apparatus. The control unit of the image forming apparatus determines whether the thickness of the sheet to be printed is equal to or larger than a predetermined thickness or not when performing printing according to the operation input. When the determination is positive, the control unit performs subsequent processes from Step S2 in the same manner as the first embodiment described above.

Modified Example 6

In the embodiments described above, regarding the size of the entirely solid image, the image forming apparatus may be able to form the entirely solid image of arbitrary size corresponding to each size (fixed size) that is set in advance for sheets to be printed, and may be able to select the size of the entirely solid image to be printed. It is possible to allow a user to select the size of the entirely solid image to be printed via the operation panel, or to allow the control unit to select the size. For example, when a user performs operation input for instructing printing of a specified image and selecting a size of a sheet to be printed via the operation panel of the image forming apparatus, the control unit may select the size of the entirely solid image according to the size of the sheet selected by the user.

Figure 15:
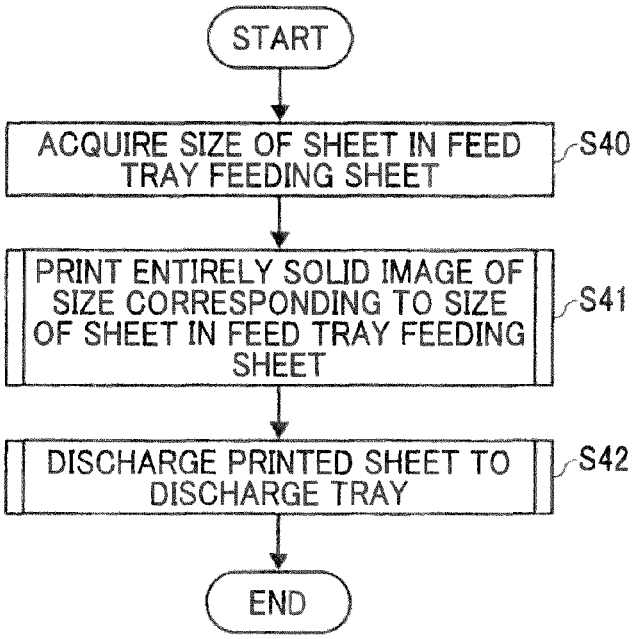
FIG. 15 is a flowchart of a procedure of an entirely-solid-image printing process according to still another modified example.

For further example, the image forming apparatus may include a plurality of feed trays with stacked transfer materials of different sizes, and, when a user selects one of the feed trays via the operation panel to perform printing, the control unit may select the size of the entirely solid image according to the size of the transfer materials stacked in the selected feed tray. In this case, it is assumed that a correspondence relation between each feed tray and a size of the transfer materials stacked in each feed tray is stored in advance. FIG. 15 is a flowchart of a procedure of an entirely-solid-image printing process according to the present modified example. When receiving, via the operation panel, operation input for instructing printing of a specified image and selecting one of the feed trays, the control unit acquires a size of the transfer materials stacked in the selected feed tray (Step S40). Subsequently, the control unit performs printing of the entirely solid image of the size corresponding to the acquired size (Step S41). The number of sheets to be printed at this time may be one or the predetermined number as described above. The process at Step S42 is the same as that of the embodiment described above.

When the transfer materials are not stacked in the selected feed tray at all, the control unit may appropriately display, on the operation panel, a message for requesting users and service men to set, to the selected feed tray, transfer materials of a size designated to be stacked in the selected feed tray.

With the configuration described above, it is possible to print the entirely solid image of an appropriate size. Consequently, it is possible to more effectively eliminate or reduce the uneven gloss at printing.

The control unit may store therein data of the entirely solid image in advance, or may create the data when it performs printing of the entirely solid image.

Modified Example 7

In the embodiments described above, an image to be printed by the image forming apparatus may be an image expressed in a raster format (referred to as a raster image). In this case, the image forming apparatus further includes a detecting unit that detects, when a user performs operation input for instructing a specified image via the operation panel of the image forming apparatus and the image forming apparatus performs normal printing, toner density of a toner image that is formed on the transfer material by using a raster image as a printing object. Then, when detecting deviated toner density on the transfer material, the control unit displays on the operation panel a message for instructing printing of the entirely solid image. In this manner, it is possible to instruct service men and users to print the entirely solid image when the uneven gloss is likely to occur because of detection of the deviated toner density on the transfer material. Therefore, it is possible to eliminate or reduce the uneven gloss at printing.

Furthermore, when detecting the deviated toner density on the transfer material, the control unit may preferably perform printing of the entirely solid image by automatically interrupting the normal printing. With this configuration, it is possible to more effectively eliminate or reduce the uneven gloss at printing.

According to the present invention, it is possible to eliminate or to reduce the uneven gloss when a toner image is fixed.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a charging unit;

an image carrier charged by the charging unit;

an exposing unit that projects light corresponding to an image to be printed to the image carrier to form a latent image;

a developing unit that forms a toner image of the latent image formed by the exposing unit and transfers the toner image to a transfer material fed from a feed tray;

a transfer belt on which the transfer material is placed, and that feeds the transfer material to the developing unit to transfer the toner image;

a fixing unit that fixes the toner image transferred onto the transfer material;

a cleaning unit that cleans up toner attached to the fixing unit; and a control unit that controls printing of the image on the transfer material, wherein the control unit causes the exposing unit to expose a latent image of a first image having an image-area ratio equal to or larger than a predetermined ratio, causes the developing unit to form a toner image of the latent image and to transfer the toner image to the transfer material, and causes the fixing unit to fix the toner image transferred by the transfer belt onto the transfer material, wherein:

the image is expressed in a raster format, and the image forming apparatus further includes:

an input receiving unit that receives operation input for instructing printing of a second image from a user; and a detecting unit that detects toner density of the toner image transferred onto the transfer material by using the second image, wherein when deviated toner density is detected, the control unit displays a message for instructing to print the first image.

2. The image forming apparatus according to claim 1, wherein the control unit controls printing of the first image on the transfer material according to the operation input received via the input receiving unit.

3. The image forming apparatus according to claim 1, wherein the control unit controls printing of the first image on the transfer material according to a type of the transfer material to be printed.

4. The image forming apparatus according to claim 1, wherein the control unit controls printing of the first image on the transfer material according to a change in a size of the transfer material to be printed.

5. The image forming apparatus according to claim 1, wherein the control unit controls printing of the first image on the transfer material according to a thickness of the transfer material to be printed.

6. The image forming apparatus according to claim 1, wherein the control unit controls printing of the first image on the transfer material when a number of transfer materials for which the fixing unit has fixed the toner image reaches a predetermined number.

7. The image forming apparatus according to claim 1, further comprising:

a determining unit that determines a number of transfer materials for which the exposing unit exposes the latent image of the image, depending on a number of transfer materials for which the fixing unit has fixed the toner image, wherein the control unit controls printing of the first image on the determined number of transfer materials.

8. The image forming apparatus according to claim 1, further comprising:

a storage unit that stores the first image of each size corresponding to each of a plurality of sizes that are set in advance as sizes of the transfer materials, wherein the control unit selects the first image of one of the plurality of sizes stored in the storage unit, and controls printing of the first image of the selected size on the transfer material.

9. The image forming apparatus according to claim 1, wherein the control unit selects the first image of a size corresponding to a size of the transfer material stacked in the feed tray, and controls printing of the first image of the selected size on the transfer material.

10. The image forming apparatus according to claim 9, further comprising:

a display control unit that displays a message for requesting to set transfer materials of a size designated to be stacked in the feed tray into the feed tray when no transfer material is stacked in the feed tray.

11. The image forming apparatus according to claim 1, further comprising:

a discharge tray to which the transfer material with a fixed toner image is discharged; and a secondary transfer belt that conveys the transfer material to the transfer unit, conveys the transfer material on which the toner image is transferred by the transfer unit to the fixing unit, and conveys the transfer material to which the toner image is fixed by the fixing unit to the discharge tray.

12. An image forming apparatus comprising:

a charging unit, an image carrier charged by the charging unit;

an exposing unit that projects light corresponding to an image to be printed to the image carrier to form a latent image;

a developing unit that forms a toner image of the latent image formed by the exposing unit and transfers the toner image to a transfer material fed from a feed tray;

a transfer belt on which the transfer material is placed, and that feeds the transfer material to the developing unit to transfer the toner image;

a fixing unit that fixes the toner image transferred onto the transfer material;

a cleaning unit that cleans up toner attached to the fixing unit; and a control unit that controls printing of the image on the transfer material, wherein the control unit causes the exposing unit to expose a latent image of a first image having an image-area ratio equal to or larger than a predetermined ratio, causes the developing unit to form a toner image of the latent image and to transfer the toner image to the transfer material, and causes the fixing unit to fix the toner image transferred by the transfer belt onto the transfer material, wherein:

the image is expressed in a raster format, and the image forming apparatus further includes:

an input receiving unit that receives operation input for instructing printing of a second image from a user; and a detecting unit that detects toner density of the toner image transferred onto the transfer material by using the second image, wherein when deviated toner density is detected, the control unit performs printing of the first image by interrupting printing of the second image.

13. The image forming apparatus according to claim 12, wherein the control unit controls printing of the first image on the transfer material according to the operation input received via the input receiving unit.

14. The image forming apparatus according to claim 12, wherein the control unit controls printing of the first image on the transfer material according to a type of the transfer material to be printed.

15. The image forming apparatus according to claim 12, wherein the control unit controls printing of the first image on the transfer material according to a change in a size of the transfer material to be printed.

16. The image forming apparatus according to claim 12, wherein the control unit controls printing of the first image on the transfer material according to a thickness of the transfer material to be printed.

17. The image forming apparatus according to claim 12, wherein the control unit controls printing of the first image on the transfer material when a number of transfer materials for which the fixing unit has fixed the toner image reaches a predetermined number.

18. The image forming apparatus according to claim 12, further comprising:

a determining unit that determines a number of transfer materials for which the exposing unit exposes the latent image of the image, depending on a number of transfer materials for which the fixing unit has fixed the toner image, wherein the control unit controls printing of the first image on the determined number of transfer materials.

19. The image forming apparatus according to claim 12, further comprising:

a storage unit that stores the first image of each size corresponding to each of a plurality of sizes that are set in advance as sizes of the transfer materials, wherein the control unit selects the first image of one of the plurality of sizes stored in the storage unit, and controls printing of the first image of the selected size on the transfer material.

20. The image forming apparatus according to claim 12, wherein the control unit selects the first image of a size corresponding to a size of the transfer material stacked in the feed tray, and controls printing of the first image of the selected size on the transfer material.

* * * * *